US005786564A

United States Patent [19]

Matsuo

[11] Patent Number: 5,786,564

[45] Date of Patent: *Jul. 28, 1998

[54] IMAGE FIXING ROLLER AND IMAGE FIXING APPARATUS CONTAINING THE SAME

[75] Inventor: Minoru Matsuo, Sagamihara, Japan

[73] Assignee: Ricoh Company, Ltd., Tokyo, Japan

[ * ] Notice: The term of this patent shall not extend beyond the expiration date of Pat. No. 5,735,936.

[21] Appl. No.: 634,735

[22] Filed: Apr. 18, 1996

[30] Foreign Application Priority Data

Apr. 18, 1995 [JP] Japan ..... 7-116287
Feb. 27, 1996 [JP] Japan ..... 8-65505

[51] Int. Cl.[6] ..... G03G 15/20

[52] U.S. Cl. ..... 219/216; 399/333

[58] Field of Search ..... 219/216, 469–471, 219/222; 399/333; 492/46; 432/60, 228

[56] References Cited

U.S. PATENT DOCUMENTS 3,689,736 9/1972 Meyer ..... 219/222
4,521,095 6/1985 Mayer ..... 219/216

*Primary Examiner*—Teresa J. Walberg
*Assistant Examiner*—J. Pelham
*Attorney, Agent, or Firm*—Oblon, Spivak, McClelland, Maier & Neustadt, P.C.

[57] ABSTRACT

The present invention relates to an image fixing apparatus for use in an electrophotographic copying machine, more particularly to an image fixing apparatus for thermally fixing toner images on a transfer sheet, and to an image fixing roller for use in the image fixing apparatus.

21 Claims, 1 Drawing Sheet

IMAGE FIXING ROLLER AND IMAGE FIXING APPARATUS CONTAINING THE SAME

BACKGROUND OF THE INVENTION

1. Field of the Invention

The present invention relates to an image fixing apparatus for use in an electrophotographic copying machine, more particularly to an image fixing apparatus for thermally fixing toner images on a transfer sheet, and to an image fixing roller for use in the image fixing apparatus.

2. Discussion of the Background

In a conventional electrophotographic copying machine provided with a laser printer, a rotatable photoconductor drum is provided, and copies are typically made with the following steps: A photoconductive portion of the photoconductive drum is uniformly charged by a charging unit, and information is recorded in the form of latent electrostatic images. The images are then developed with toner to give toner images by a development unit in the electrophotographic copying machine. The developed toner images are transferred to a recording sheet, which is then passed through an image fixing apparatus, in which the toner images are thermally fixed to the recording sheet.

In the above-mentioned conventional image fixing apparatus, an image fixing roller is employed, which is composed of a hollow core cylinder made of, for instance, aluminum, and a toner-releasing layer which is made of, for instance, a fluoroplastic, and provided on the outer peripheral surface of the hollow core cylinder.

In the image fixing roller, a heater such as a halogen lamp is provided in a vacant portion within the hollow core cylinder along the cylinder's axis of revolution, whereby the image fixing roller is heated from the inside by radiant heat.

In parallel with the conventional image fixing roller, there is provided a pressuring roller which comes into pressure contact with the peripheral surface of the image fixing roller.

The toner image-bearing recording sheet is transported so as to pass through the contact portion between the two rollers, where the toner images transferred to the recording sheet are softened by the heat from the image fixing roller and fixed to the recording sheet held between the two rollers, with the application of pressure thereto by the pressure application roller.

In such an image fixing apparatus, however, a relatively long warm-up time is required, after the power supply is turned on, to reach the necessary predetermined image fixing temperature on the outer peripheral surface of the image fixing roller.

In order to shorten the warm-up time, conventionally, when the main switch of the machine is turned on, electricity is applied to the heater of the image fixing apparatus, thus starting the preheating of the image fixing roller. This method, however, has the shortcoming of wasting a significant amount of energy.

Further, in order to avoid the above problem, there have been proposed the following exemplary methods for shortening the warm-up time for such an image fixing roller:

A method of providing a resistive heat emitting layer at or near the peripheral surface of an image fixing roller (Japanese Laid Open Patents 55-164860, 56-138766 and 2-285383); a method of blackening the inner wall of a hollow portion of an image fixing roller to increase the radiant efficiency thereof, thus increasing the heat decalescence efficiency, a method of increasing the surface area of the inner wall of a hollow portion of an image fixing roller by roughening the surface of the inner wall (Japanese Laid Open Patent 4-34483 and 4-134387), a method of constructing an image fixing roller composed of a heat pipe (Japanese Laid-Open Patent 3-139684); a method of heating an image fixing roller by electromagnetic induction (Japanese Utility Model 4-55055); a method of constructing an image fixing roller (Japanese Laid Open Patent 4-186270); and a method of constructing an image fixing roller which includes a cylindrical heater in which a positive thermistor material is used (Japanese Laid Open Patent 4-42185).

In order to make the above-mentioned methods actually effective in practical use, it is required that the core roller for each of the image fixing rollers have good heat conductivity. However, reduction of the thickness of the core roller for increasing the heat conductivity is limited in view of the mechanical strength required for practical use of the image fixing roller. Therefore, the above-mentioned methods are not always effective. Furthermore, a large amount of energy must be applied to the heating elements, such as heaters for the image fixing rollers in order to sufficiently shorten the warm-up time for such conventional image fixing rollers.

SUMMARY OF THE INVENTION

Therefore, one object of the present invention is to provide an image fixing apparatus comprising an image fixing roller, wherein the apparatus is capable of sufficiently reducing the warm-up time for the image fixing roller for practical use, without being restricted by the thermal conductivity of a core roller member for the image fixing roller.

Another object of the present invention is to provide an image fixing apparatus capable of sufficiently reducing the warm-up time without a large amount of energy.

Another object of the present invention is to provide an image fixing roller for use in the above-mentioned image fixing apparatus.

These and other objects of the present invention have been satisfied by the discovery of an image fixing apparatus having an image fixing roller for thermally fixing images on an image receiving material at a predetermined image fixing temperature, the image fixing roller comprising a roller member and an exothermic phase transition layer provided on an exterior surface of said roller member, wherein the exothermic phase transition layer comprises a) an exothermic phase transition material capable of undergoing a reversible phase transition from an amorphous state to a crystalline state repeatedly and crystallizing at a crystallization temperature and b) a protection layer for sealing the exothermic phase transition layer to the roller member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
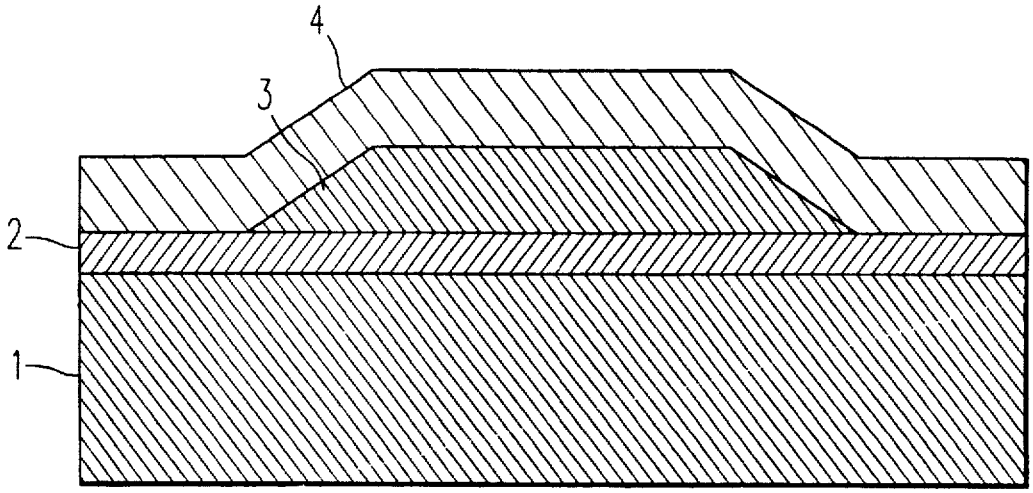
FIG. 1 is a sectional view of part of a fixing roller in an axial direction showing a core 1, an oxidized film layer 2, an exothermic phase transition layer 3 and a protecting layer 4 which also functions as a toner releasing layer.

The exothermic phase transition layer of the present invention is capable of repeatedly undergoing a phase transition from an amorphous state to a crystalline state and emits heat when changing from the amorphous state to the crystalline state.

Further, the exothermic phase transition layer does not melt during fixing and the melting point of the exothermic phase transition layer is higher than that of the toner fixing temperature. Preferably, the exothermic phase transition layer can easily perform the phase transition.

Materials used in the present exothermic phase transition layer include crystalline resins such as PET, PE (Polyethylene), PP (Polypropylene), Si-S, Si-Te, As-S-Se-Te, and other chalcogen alloys, oxides such as $P_2O_5$, $Te_2O_3$. Amorphous materials of the Groups III to VI having chalcogens as the main component are also effective. For example, materials of Groups III to VI of the periodic table are preferred, such as selenium, selenium-tellurium alloys, tellurium, germanium alloys, selenium-indium based alloys, tellurium-indium based alloys, selenium-antimony based alloys or tellurium-antimony based alloys. Selenium-tellurium is most preferred.

In the present invention, the exothermic phase transition layer is provided on a surface of a metal core through an oxidized metal film layer. The oxidized metal film provides good adhesion of the exothermic phase transition layer to the surface of the roller member. The metal core can be a core of a fixing roller having a heater therein. Suitable heaters include a halogen lamp, infrared lamp, Ni-Cr wire or Nickrome wire (Trademark), or the fixing roller can comprise a heat pipe or a resistive heat emitting layer.

Further, the exothermic phase transition layer has a protecting layer covering its edges.

In the present invention, in terms of ease of manufacture, it is preferred that the exothermic phase transition layer consists of an amorphous material of Group III to VI chalcogens and is provided on a surface of a metal core through an oxidized metal film layer. The core has a heater therein but can itself emit heat by applying electricity to the core.

For example, it is possible to form an oxidized metal film layer on a metal surface by heating and baking (calcining) a roller having a metal surface in the air or an oxygen atmosphere.

As a roller member, stainless steel is preferable. By using stainless steel, it is possible to easily form an oxidized metal film layer.

Since stainless steel has mechanical strength, it is possible to reduce the thickness of the core, whereby it is possible to also improve the efficiency of thermal conductivity.

It is also possible to use a stainless steel core itself as a heating element.

In the present invention, it is preferable to form an exothermic phase transition layer on a metal surface, leaving surfaces of edge portions in an axial direction of the roller without a covering, and to provide a protecting layer on the surfaces of both the exothermic phase layer and these edge portions not covered with an exothermic phase transition layer.

Further it is preferable to form a toner releasing layer to protect toner from adhering on the outer surface of the fixing roller.

The toner releasing layer can also function as both a releasing layer and a protection layer.

The toner releasing layer can be formed by conventional methods, however, it is preferable to form the releasing layer by covering and heating a thermally contracting tube of a fluoropolymer resin on the roller. When the thermally contracting tube covers both edge portions of the roller, the side edge portions of the exothermic phase transition layer can be sealed.

In case of formation of a layer which contains thermally conductive material or an exothermic phase transition layer, material having a thermal conductivity which is higher than that of the exothermic phase transition material or material of the protecting layer is mixed in at least one of the layers, and has a higher melting point than that of the fixing temperature.

For example, the protecting layer can be formed by covering the exothermic phase transition layer, formed on a surface of the fixing roller, using a thermally contracting tube, such as PFA resin, which contains a thermally conductive material.

Alternatively the protecting layer can be film, such as PFA resin which contains thermally conductive material. This film can be provided on the exothermic phase transition layer by evaporating the thermally conductive material and resin, such as PFA resin, at the same time from one or more evaporation sources using a vacuum deposition method.

Further, the protecting layer can be made by adding an evaporation source of a thermally conductive material when forming the exothermic phase transition layer by evaporation.

Alternatively, the protecting layer can be made by evaporation by adding a thermally conductive material into an evaporation source for forming the exothermic phase transition layer.

Suitable thermally conductive materials can be selected by measuring the thermal conductivity of the exothermic phase transition layer or the protecting layer in the crystallized state (i.e., crystallized from the amorphous state) and selecting a conventional thermally conductive material which has a higher thermal conductivity than that of the exothermic phase transition layer or protecting layer.

Examples of such thermally conductive materials include metals, such as aluminum, copper, gold, or silver, metal oxides such as aluminum oxide and titanium dioxide ($TiO_2$), titanium oxide (TiO), tellurium, antimony, carbon fine particles or carbon fibers or fibrils. Among these, Al, Au, Ag, carbon fine particles, carbon fibers or fibrils, tellurium and antimony are preferred Depending on the material and property desired, the amount of thermally conductive material added varies and is preferably from 0 to 50 weight percent based on total weight of the layer in which the thermally conductive material is contained.

In FIG. 1, one embodiment of the fixing roller of the present invention is shown. The fixing roller is made up of a core 1, an oxidized film layer 2, an exothermic phase transition layer 3 and a protecting layer 4 which also functions as a toner releasing layer.

Figure 2:
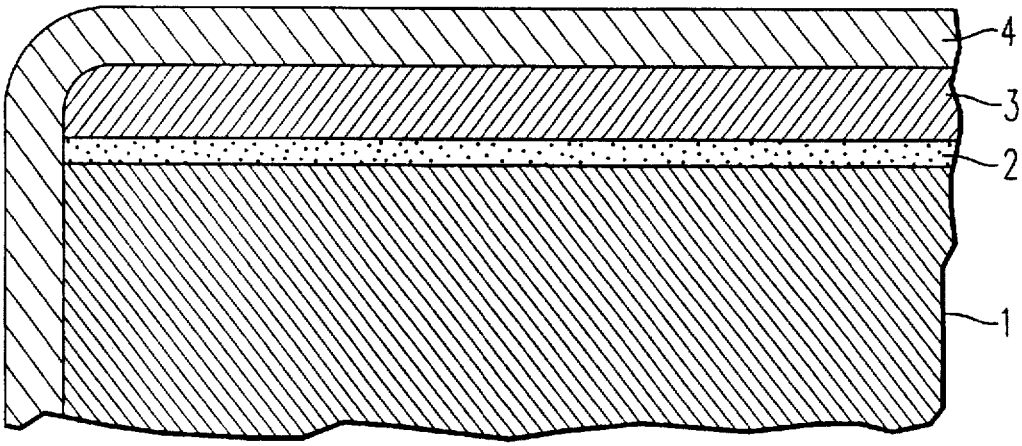
FIG. 2 is a sectional view of part of another embodiment of the present fixing roller in an axial direction.

FIG. 2 shows another embodiment of the fixing roller of the present invention, prepared as follows:

An oxidized film layer 2 is formed on a peripheral surface of core 1, having a 40 mm diameter, by electrostatically painting with a powder of conductive fluorine resin (MP611 made by Mitsui Chemical Co.) mixed with 50 wt. % of selenium fine particles and preliminarily baking the painted core at 250° C., whereby exothermic phase transition layer 3 is formed. Further, a thermally contracting tube made of, for instance, a conductive PFA resin, is covered on the core and the core heated at 300° C., whereby toner releasing layer 4 having a 10 μm thickness is formed.

In the fixing roller of the present invention, when the exothermic phase transition layer in the amorphous state reaches a temperature for crystallizing by being heated by the heating element of the fixing roller, the heat of crystallization is emitted, whereby the temperature of the exothermic phase transition layer rises rapidly. Accordingly, since the surface of the fixing roller rapidly reaches a temperature capable of fixing, it is possible to reduce warm-up time.

After the surface of the fixing roller reaches a temperature for fixing, this fixing temperature is controlled by heat from the heating element. However, thermal conductivity of the exothermic phase transition layer becomes high, whereby it is possible to control the fixing temperature more easily.

When finishing the copying process, by temporarily heating the exothermic phase transition layer, then in a crystalline state, to more than the melting temperature, by the heating element, wherein the exothermic phase transition layer is brought into a liquid state, and cooling the layer, wherein the exothermic phase transition layer returns to the amorphous state, whereby it is possible to restart the process.

Accordingly, it is always possible to make the surface of the fixing roller rapidly rise to the fixing temperature.

As described above, the present exothermic phase transition layer has the following properties:

(1) Phase transition occurs completely between the amorphous state and a crystalline state.

(2) The glass transition point, Tg, is more than room temperature.

(3) The crystallization temperature, Tc, is between room temperature and a fixing temperature, Tt, of about 200° C.

(4) The melting point temperature, Tm, of the layer is higher than the fixing temperature, Tt, and is as low as possible.

(5) The layer does not change in quality even if melting and crystallizing are repeated.

Selenium or a selenium-tellurium alloy wherein selenium is the major component is preferably as the exothermic phase transition layer, more preferably a selenium-tellurium alloy, wherein selenium is the major component. A major compnent is preferably >50 wt. %.

If an exothermic phase transition layer comprises an amorphous material of Group III to VI of the periodic table and having a chalcogen as a main component is conventionally formed on a metal surface, such as Al or SUS, may be easy to peel off the exothermic phase transition layer from the surface. When the exothermic phase transition layer is formed through a metal oxide film layer on the metal surface, it is possible to prevent the exothermic phase transition layer from peeling off and improve the durability of the fixing roller.

It is also possible to increase the adhesion of the exothermic phase transition layer to the roller by roughening the surface of the roller, for example with an abrasive.

In the present invention, for ease of manufacture, it is preferable to form the exothermic phase transition layer on a metal core surface through an oxidized metal film layer.

By using stainless steel as the core, it is easy to form the oxidized film layer. Since stainless steel has mechanical strength, it is also possible to make the core thin, whereby it is possible to improve thermal conductivity and further, to sufficiently shorten the warm-up time using a small amount of energy for the heating element.

By using a stainless core itself as the heating element, it is possible to even further shorten the warm-up time.

In the present invention, since the exothermic phase transition layer contains a thermally conductive material with a thermal conductivity which is more than that of the amorphous material at its crystallizing state, it is possible to rapidly conduct the heat onto a surface of the fixing roller even if heat is rapidly created by crystallizing of the amorphous material when the exothermic phase transition is heated by the heating element. It is possible to also prevent the amorphous material from self-metalling and to sufficiently shorten the warm-up time of the fixing roller by efficiently using the heat of crystallization of the amorphous material.

As conductive material to be mixed with the exothermic phase transition layer, Au, Ag, Al, Sb or a mixture thereof are preferred.

These materials are useful because they can be co-evaporated. Therefore, it is possible to rapidly conduct heat which is created in the exothermic phase transition layer onto a surface of a fixing roller.

In the present invention, a protecting layer is provided to seal the exothermic phase transition layer and its side edges. In order that the crystallized exothermic phase transition layer is again changed from the crystalline state to the amorphous state and the heat of crystallization is emitted by being heated by a heating element, the exothermic phase transition layer is heated temporarily at more than its melting point by a heating element. However, by providing a protection layer to seal the side edge portions of the exothermic phase transition layer and covering the layer, it is possible to prevent the melting exothermic phase transition layer from flowing out of the fixing roller when the exothermic phase transition layer is melted.

In making the protecting layer for covering the exothermic phase transition layer and sealing the side edge portions of the exothermic phase transition layer, it is preferable to provide the protection layer so as to seal the exothermic phase transition layer and metal surfaces of the end portion in an axial direction of the fixing roller, and on which the exothermic phase transition layer is not provided. This makes it possible to prevent the melting exothermic phase transition layer from outflowing from the end portions of the fixing roller.

Further, it is preferable that a toner releasing layer is provided for preventing toner from adhering on the outer surface of the fixing roller. It is possible to have both toner releasing and protecting functions in the toner releasing layer. The toner releasing layer can be prepared on the fixing roller using conventional methods, but it is preferable to provide the toner releasing layer by covering and heating a fluoropolymer resin-based thermally contracting tube on the fixing roller. The side end portions of the exothermic phase transition layer can be sealed if the thermally contracting tube is provided so as to cover both end portions of the fixing roller.

Having generally described this invention, a further understanding can be obtained by reference to certain specific examples which are provided herein for purposes of illustration only and are not intended to be limiting unless otherwise specified.

EXAMPLE 1

An Al core with a 20 mm diameter and a 0.4 mm thickness was heated at 120° C. for about 30 minutes in a baking furnace having an oxygen atmosphere to make an oxidized aluminum film layer on the Al core surface. The brightness of the core changed from a yellow-like color to a metal brightness.

The core was placed in a tub for vacuum-evaporation and an exothermic phase transition layer with a 0.1 mm thickness formed thereon by evaporating selenium-tellurium alloy containing 8 weight % of tellurium on the oxidized film layer. After taking the core out of the tub, the core having the oxidized film layer was covered with a thermally contracting tube and heated at 300° C. of a conductive PFA resin and the assembly heated, whereby a toner releasing layer of 20 μm thickness was formed which also functioned as a protecting layer.

EXAMPLE 2

An SUS304 core with a 20 mm diameter and a 0.8 mm thickness was heated at 500° C. for about 80 minutes in air to provide an oxidized film layer on a peripheral surface of the SUS304 core. After the core was heated for 10–15 minutes at a fixed temperature, the core started to color and further, the temperature fell down to 450° C. Brightness of the core changed from silver-white to black-brown.

The core was set in a tub for vacuum-evaporation and an exothermic phase transition layer with 0.1 mm thickness formed by evaporating a selenium-tellurium alloy containing 30 wt. % of tellurium on the oxidized film layer. After taking the core out of the tub, a thermally contracting tube of conductive PFA resin was covered onto the core and heated at 300° C., whereby a toner releasing layer of 10 μm thickness was formed which functioned as both a protecting layer and a toner releasing layer.

COMPARATIVE EXAMPLE

A fixing roller was prepared as in the above-mentioned Examples 1 and 2, except that a core was used which was not heated (i.e. an oxidized film layer was not formed on the surface of the core).

The fixing roller made in this way was placed in a fixing device of a Ricoh Facsimile machine F17 (made by Ricoh) and electric power was applied to a 680W halogen lamp disposed in the core. The temperature rising speed of the surface of the fixing roller was measured and found that the temperature rising speed in the roller which has an exothermic phase transition layer is about 1.5 times as fast as that in the fixing roller which has no exothermic phase transition layer.

Durability of the fixing roller was evaluated by repeatedly turning on and off the electricity in a 680W halogen lamp. As a result, the exothermic phase transition layer peeled off after repeating 5000 times, with wrinkle started occurring on the surface of the toner releasing layer. In that state, it was impossible to pass a paper sheet through to fix a toner image on the paper sheet, but in the fixing rollers of the present invention Examples 1 and 2, there was no peeling-off of the exothermic phase transition layer and no change on the surface of the toner releasing layer even after 50,000 printing repetitions. It was possible to get a good fixed image by passing paper sheets through with toner images.

EXAMPLE 3

A sliding electrode was provided on both end portions of the fixing roller as prepared in Example 2 and electric power was applied (1.5V and 80A) to the core of the fixing roller. The temperature of the surface of the fixing roller was raised more rapidly than when heated with a halogen lamp and shorten the warm-up time. The fixing roller was placed in a fixing device of a Ricoh facsimile machine F17 (made by Ricoh) and paper sheets with toner images were passed through the fixing device. As a result, good images were provided on the paper sheets.

This application is based on Japanese Patent Applications JP 7-116,287 and JP 8-65505, filed with the Japanese Patent Office on Apr. 18, 1995 and Feb. 27, 1996, the entire contents of which are hereby incorporated by reference.

Obviously, additional modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A fixing roller comprising:

1) a roller member;

2) an exothermic phase transition layer which has a melting point temperature which is higher than that of a toner fixing temperature provided on an exterior surface of said roller member, wherein said exothermic phase transition layer comprises an exothermic phase transition material which emits heat when changing from an amorphous state to a crystalline state and is capable of reversible phase transition from an amorphous state to a crystalline state repeatedly; and 3) a protection layer comprising a protection layer material, which seals said exothermic phase transition layer and side portions of said exothermic phase transition layer to said roller member.

2. The fixing roller of claim 1, wherein said roller member further comprises a metal surface on which said exothermic phase transition layer is provided.

3. The fixing roller of claim 1, wherein said roller member is made of metal.

4. The fixing roller of claim 2, further comprising a metal oxide layer on said metal surface.

5. The fixing roller of claim 1, wherein said exothermic phase transition layer further comprises a thermally conductive material which has a melting point which is higher than a fixing temperature and has a greater thermal conductivity than a thermal conductivity of said exothermic phase transition material.

6. The fixing roller of claim 1, wherein said protecting layer further comprises a thermally conductive material which has a melting point which is higher than a fixing temperature and which has a thermal conductivity greater than a thermal conductivity of said protecting layer material.

7. The fixing roller of claim 2, wherein said metal surface is made from stainless steel.

8. The fixing roller of claim 1, further comprising a toner releasing layer on an outer surface of said fixing roller.

9. The fixing roller of claim 1, wherein said protecting layer has a toner releasing layer property.

10. The fixing roller of claim 1, wherein said protecting layer is formed by thermally contracting a tube onto said roller member with an exothermic phase transition layer provided thereon.

11. The fixing roller of claim 2, wherein said exothermic phase transition layer does not cover side portion of said roller member in an axial direction of said roller member and said protecting layer covers said exothermic phase transition layer and side portion of said roller member in an axial direction of said roller member.

12. A fixing apparatus comprising:

A) a fixing roller comprising 1) a core roller member;

2) an exothermic phase transition layer which has a melting point temperature which is higher than that of a toner fixing temperature provided on an exterior surface of said core roller member, wherein said exothermic phase transition layer comprises an exothermic phase transition material which emits heat when changing from an amorphous state to a crystalline state and is capable of reversible phase transition from an amorphous state to a crystalline state repeatedly; and 3) a protection layer which seals said exothermic phase transition layer and side portions of said exothermic phase transition layer to said roller member;

B) a heating element provided inside said fixing roller.

13. An image forming apparatus comprising:

A) an image former; and

B) a fixing roller comprising:

1) a core roller member;

2) an exothermic phase transition layer which has a melting point temperature which is higher than that of a toner fixing temperature provided on an exterior surface of said core roller member, wherein said exothermic phase transition layer comprises an exothermic phase transition material which emits heat when changing from an amorphous state to a crystalline state and is capable of reversible phase transition from an amorphous state to a crystalline state repeatedly; and 3) a protection layer which seals said exothermic phase transition layer and side portions of said exothermic phase transition layer to said core roller member;

C) a heating element provided inside said fixing roller.

14. A method of increasing the rate of heating of a fixing roller comprising applying 1) an exothermic phase transition layer which has a melting point temperature which is higher than that of a toner fixing temperature provided on an exterior surface of a roller member, wherein said exothermic phase transition layer comprises an exothermic phase transition material which emits heat when changing from an amorphous state to a crystalline state and is capable of reversible phase transition from an amorphous state to a crystalline state repeatedly; and 2) a protection layer which seals said exothermic phase transition layer and side portions of said exothermic phase transition layer to a roller member;

to the surface of a roller member.

15. The fixing roller of claim 1, wherein said exothermic phase transition material is selected from the group consisting of PET, polyethylene, polypropylene, Si-S, Si-Te, As-S-Se-Te, $P_2O_5$ and $Te_2O_3$.

16. The fixing roller of claim 1, wherein said exothermic phase transition material comprises a material of the Groups III to VI of the periodic table and having a chalcogen as the main component.

17. The fixing roller of claim 1, wherein said exothermic phase transition material is a selenium-tellurium alloy having selenium a major component.

18. The fixing roller of claim 1, wherein said protecting layer material is PFA resin.

19. The fixing roller of claim 5, wherein said thermally conductive material is selected from the group consisting of aluminum, copper, gold, or silver, aluminum oxide, titanium dioxide, titanium oxide, tellurium, antimony, carbon fine particles, carbon fibers, carbon fibrils and a mixture thereof.

20. The fixing roller of claim 6, wherein said thermally conductive material is selected from the group consisting of aluminum, copper, gold, or silver, aluminum oxide, titanium dioxide, titanium oxide, tellurium, antimony, carbon fine particles, carbon fibers, carbon fibrils and a mixture thereof.

21. In an image forming apparatus comprising a fixing roller, the improvement comprising said fixing roller comprises:

1) a core roller member;

2) an exothermic phase transition layer which has a melting point temperature which is higher than that of a toner fixing temperature provided on an exterior surface of said core roller member, wherein said exothermic phase transition layer comprises an exothermic phase transition material which emits heat when changing from an amorphous state to a crystalline state and is capable of reversible phase transition from an amorphous state to a crystalline state repeatedly; and 3) a protection layer which seals said exothermic phase transition layer and side portions of said exothermic phase transition layer to said core roller member.

* * * * *